US005255960A

United States Patent [19]

Ilomäki

[11] Patent Number: 5,255,960

[45] Date of Patent: Oct. 26, 1993

[54] TUNNEL DRILLING APPARATUS WITH DRILL WASTE REMOVAL

[76] Inventor: Valto Ilomäki, Loilantie 8, SF-33470 Ylöjrvi, Finland

[21] Appl. No.: 838,796

[22] PCT Filed: Sep. 27, 1990

[86] PCT No.: PCT/FI90/00228

§ 371 Date: Mar. 17, 1992

§ 102(e) Date: Mar. 17, 1992

[87] PCT Pub. No.: WO91/05141

PCT Pub. Date: Apr. 18, 1991

[30] Foreign Application Priority Data

Sep. 27, 1989 [FI] Finland ..... 894559

[51] Int. Cl.[5] ..... E21D 9/08

[52] U.S. Cl. ..... 299/56; 299/31; 405/141

[58] Field of Search ..... 299/31, 33, 56; 405/138, 141, 140

[56] References Cited

U.S. PATENT DOCUMENTS 2,919,121 12/1959 Ruth .
3,005,627 10/1961 Tinlin ..... 299/56
4,122,683 10/1978 Follert et al. ..... 405/142
4,534,676 8/1985 Saito ..... 299/31

FOREIGN PATENT DOCUMENTS

20047/88 4/1990 Australia .

*Primary Examiner*—David J. Bagnell
*Attorney, Agent, or Firm*—Larson and Taylor

[57] ABSTRACT

A drill head for drilling a tunnel in rock or soil comprises a rotatable drill bit assembly and a cylindrical protecting tube. The bit assembly comprises a bit holder and a cylindrical drill bit. The bit assembly has a cylindrical surface which forms a continuous cylindrical lap joint with the protecting tube. The bit assembly also has at least one opening for removing, through the bit assembly, drill cuttings from the face of the drill bit. In use, the lap joint allows rotation of the drill bit assembly relative to the protecting tube and prevents access of the drill cuttings to the outside of the drill head.

8 Claims, 1 Drawing Sheet

TUNNEL DRILLING APPARATUS WITH DRILL WASTE REMOVAL

The invention relates to a tunnel drilling apparatus provided with a working tool at drill head and to a method by means of which the drill waste is removed from the working tool inside the protecting pipe.

Previously is known tunnel drilling apparatus with one working tool a.o. from the U.S. Pat. No. 4,122,683. A working drill head that rotates on cutting the tunnel front wall is introduced in the publication. The excavated material is shifted into the protecting tube of the drill head and further to the rear end of the apparatus. The apparatus has a plurality of abutments immobilized against the tunnel walls enabling adjustment of the drilling direciton by providing support from the tunnel walls to the protecting tube and turning the tool or the mobile part of the tool head in desired direction for instance by means of turning cylinders.

The U.S. Pat. No. 2,919,121 introduces an apparatus with one tunnel drilling tool by means of which excavated material is shifted into a rotating tube. Outside this tube there is another tube, the actual protecting tube enveloping the drill head. This tube is supported by wheels and expanding ring segments against the tunnel walls and adjustment of the drilling direction is provided with these wheels and ring segments.

The disadvantage of the above described solutions is characterized in that the excavated material has access to the bottom of the tunnel during working because of the placement of bit components in applied tools with respect to the protecting tube. A space is left open between the bits and the protecting tube, where excavated material simply piles up. It is complicated to force the material between the protecting tube and the driving tube and even not quite possible in driving a tunnel in unbroken rock. In these cases, a certain quantity of drill waste always remains in the tunnel, which means hindrance to the drill head alignment, since control of driving is effected through leaning on the tunnel walls. Then disturbing drill waste piles up especially in the lower parts of the tunnel and wedges itself between the protecting tube and the tunnel.

The method and apparatus according to this invention provide a crucial improvment of said disadvantages. In order to put this into practice, the method and apparatus are characterized in what has been described in the enclosed patent claims.

It can be considered the main advantage of the invention that the drill head can force itself through to the inner surface of the reliably waste-free tunnel which makes it possible to use a simple direct forward-driving drill head without any kind of control equipment. Furthermore, a lap joint prevents access of loose soil from tunnel upper surface to striking bit neck portion, where it would cause interruption of drill bit stroke in no time at all. Advantageously, the method of this invention is applicable to tunnels with small-sized diameters, preferably to ones with diameters under 800 mm. In addition, the advantage of this invention is increased since it is especially difficult to furnish small-diameter drill heads with control equipment.

In the following the invention is described in detail with reference to the enclosed drawing.

Figure 1:
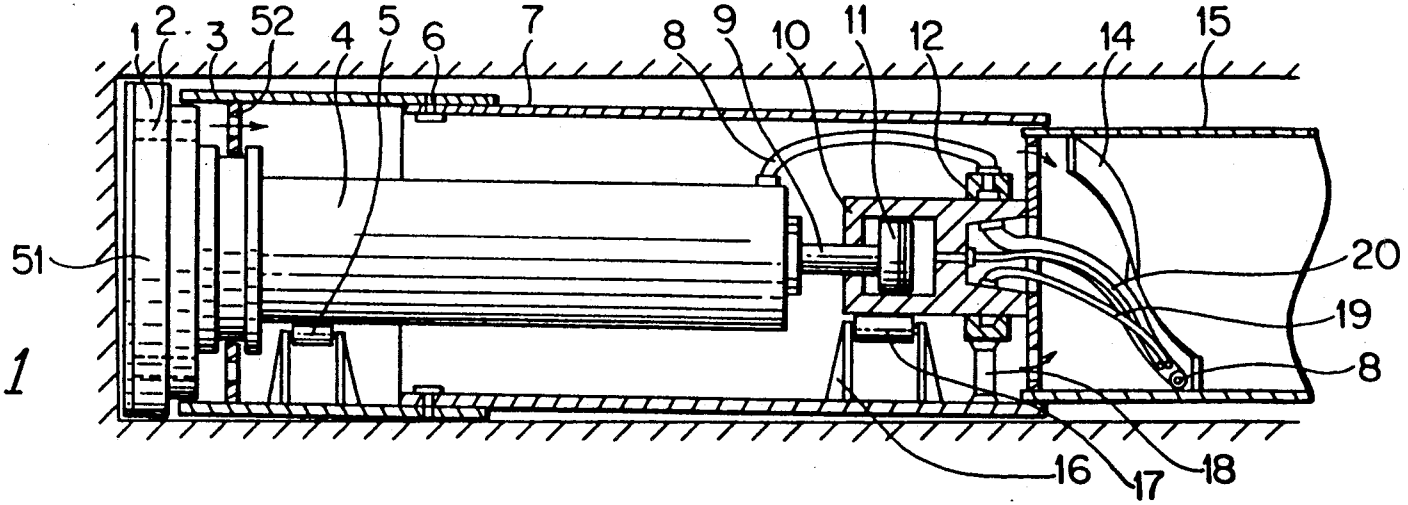
FIG. 1 is a drill head with a tool.

The tool (4) in FIG. 1 comprises a bore bit holder (51) with openings (2), along which the drill waste is conveyed by compressed air from the front end of bit 1 to the protecting tubes (3,7). Compressed air enters the tool along a hose (8) and at least a part of it is conducted to the bit front end to convey drill waste. Between the drill bit holder and its protecting tube (3), there is a lap joint to prevent access of drill waste to the outside of the protecting tube. Arrangement of position and direction of openings (2) makes it possible to provide an ejector effect in the lap joint so that even drill waste, which may have somehow passed the drill bit, is sucked up into the protecting tube. The collar ring (52) provided with openings is attached to the protecting tube but is, on the other hand, also in a groove of the tool, thus securing the lap joint when the bit component is moving in operation.

The protecting tube comprises two parts, one of them (7) attached to the other by screws (6). The tool is supported with rolls (5, 17) against the protecting tubes. The hydraulic cylinder (10), the piston (11) and the piston rod (9) function as a thrust bearing. The rotating conveyor drum (15) has ribbings (14) that convey the waste away from the drill head. The line of compressed air and the hydraulic hoses (19, 20) to the drill head are arranged in the back of this ribbing. Compressed air is conducted from the rotating tube by means of a collector ring (12) to an immobile pipe. The collector ring is secured to the protecting tube with braces (18).

Figure 2:
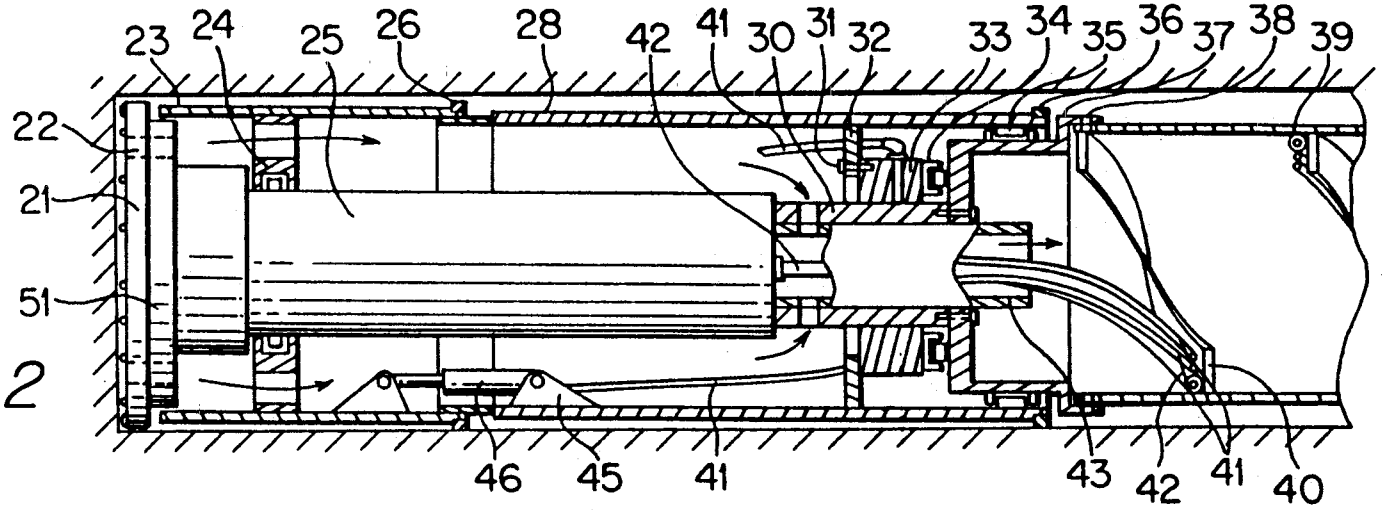
FIG. 2 is a drilling apparatus resting on the tunnel bottom firmly supported by the steering tunnel walls.

The tool (25) in FIG. 2 is provided with a drill bit (21) and a bit holder (51). Compressed air is conducted also to the bit front end and further through the bit and its openings (22) into the pretecting tubes (23, 28) to convey waste as it advances. The tool head is secured with a bearing support (24). In the protecting tubes holdfast points against tunnel bottom adjusting rings (26,36) are fitted with screws (not shown). Adjustming rings of different height or only sliding brackets (38) can be used on protecting tubes lower surface. The interterposition of the protecting tubes can be adjusted with turning cylinders (46) secured with brackets (45) to the protecting tubes. The rotating motion is brought to the tool by means of a conveying drum (39) provided with an internal ribbing (40) and a compressed air line (42) and hydraulic hoses (41) are arranged behind it. To the front edge of the conveying drum (39) a cylindrical part (37) is fastened with brackets (38), the front face of which functions as a thrust bearing area and the shell surface as a radial bearing area. From this part the rotation is transmitted to the tool by means of a bushing (30). The inner bushing (43) is also rotating and from its inside the drill waste is shifted to the conveying drum. Around the bushing (30) an immobile hydraulic pressure distributor (33) is blocked into position by means of a collar ring (32). The roller system (34) functions as a thrust bearing and the rollers (35) as a radial bearing.

This invention is not restricted to the embodiments of prior art but it can be modified within the limits of the enclosed patent claims.

I claim:

1. A drill head comprising a rotatable bit assembly and a cylindrical protecting tube, said bit assembly comprising a bit holder and a cylindrical drill bit, said bit assembly having a cylindrical surface for forming a continuous cylindrical lap joint with said protecting tube, said lap joint allowing relative longitudinal movement of said bit assembly and said protecting tube, and having at least one opening for removal, through the bit assembly, of drill cuttings from the face of the drill bit, said cylindrical protecting tube forming with said cylindrical surface of said drill bit assembly a continuous cylindrical lap joint between said bit assembly and said protecting tube, said lap joint, in use of the drill head, allowing rotation of said drill bit assembly relative to said protecting tube and preventing access of said drill cuttings to the outside of said drill head.

2. A drill head according to claim 1 wherein said cylindrical drill bit comprises a percussing bit.

3. A drill head according to claim 1 further comprising means for forcing said drill cuttings through said at least one opening in said bit assembly.

4. A drill head according to claim 1 wherein said lap joint is at least as long as the distance of said relative longitudinal movement.

5. A drill head according to claim 1 further comprising means for limiting said relative longitudinal movement.

6. A drill head according to claim 5 wherein said movement limiting means comprises a cylindrical collar fixed to the inner surface of said protecting tube.

7. A drill head according to claim 6 wherein said movement limiting means further comprises a cylindrical groove in said bit assembly, said cylindrical collar being longitudinally moveable in said groove and being engageable with the walls of said groove.

8. A drill head according to claim 1 wherein said cylindrical surface is provided on said bit holder.

* * * * *